US005401226A

United States Patent [19]

Stearns

[11] Patent Number: 5,401,226

[45] **Date of Patent: * Mar. 28, 1995**

[54] EXERCISE DEVICE

[75] Inventor: Kenneth W. Stearns, Houston, Tex.

[73] Assignee: Stearns Technologies, Inc., Houston, Tex.

[ * ] Notice: The portion of the term of this patent subsequent to Mar. 1, 2011 has been disclaimed.

[21] Appl. No.: 163,822

[22] Filed: Dec. 8, 1993

Related U.S. Application Data

[63] Continuation-in-part of Ser. No. 968,196, Oct. 29, 1992, Pat. No. 5,290,211.

[51] Int. Cl.[6] ..... A63B 22/00

[52] U.S. Cl. ..... 482/53; 482/51; 482/70

[58] Field of Search ..... 482/51–53, 482/70, 71, 57, 148, 54, 74

[56] References Cited

U.S. PATENT DOCUMENTS

| | | | |
|---|---|---|---|
| 1,909,190 | 2/1931 | Sachs . | |
| 3,316,898 | 10/1964 | Brown . | |
| 3,756,595 | 9/1973 | Hague . | |
| 3,970,302 | 7/1976 | McFee . | |
| 4,496,147 | 1/1985 | Decloux et al. . | |
| 4,685,666 | 8/1987 | Decloux . | |
| 4,709,918 | 12/1987 | Grinblat . | |
| 4,720,093 | 1/1988 | Del Mar . | |
| 4,733,858 | 3/1988 | Lan . | |
| 4,779,863 | 10/1988 | Yang | 482/57 |
| 4,786,050 | 11/1988 | Geschwender . | |
| 4,951,942 | 8/1990 | Walden . | |
| 5,000,442 | 3/1991 | Dalebout et al. . | |
| 5,048,821 | 9/1991 | Liang . | |
| 5,062,627 | 11/1991 | Bingham . | |
| 5,078,389 | 1/1992 | Chen . | |
| 5,195,935 | 3/1993 | Fencel . | |
| 5,242,343 | 9/1993 | Miller | 482/52 |
| 5,279,529 | 1/1994 | Eschenbach | 482/51 |
| 5,290,211 | 3/1994 | Stearns | 482/51 |

*Primary Examiner*—Stephen R. Crow
*Attorney, Agent, or Firm*—Bush, Moseley, Riddle & Jackson

[57] ABSTRACT

An exercise device (10) has foot supports (30, 32) on which a user stands for performing a stair stepping exercise alone, or a cross country skiing exercise alone, or simultaneously a stair stepping exercise and a cross country skiing exercise. Linkage support frames (26, 28) each have a first linkage (44) and a second linkage (36) pivotally connected to each other for maintaining foot supports (30, 32) in a horizontal plane. A fluid cylinder (52) provides a mechanism for resisting the vertical movement of the foot supports (30, 32). Manually gripped poles (60) are mounted to move in coordination with generally horizontal movement of foot supports (30, 32). Separate embodiments of the invention are shown in FIGS. 5–13 for performing simultaneously a stair stepping exercise and a cross country skiing or walking exercise. An alternative preferred embodiment of the invention which may be folded downwardly for low vertical profile storage is illustrated in FIG. 14. Another embodiment illustrated in FIGS. 16–19 is directed to an exercise device in which a foot support assembly (49K) is mounted on guides defined by a four bar parallelogram linkage (44K) and maintains a generally horizontal position during raising and lowering of the linkage (44K) during the exercise.

26 Claims, 7 Drawing Sheets

FIG. 5
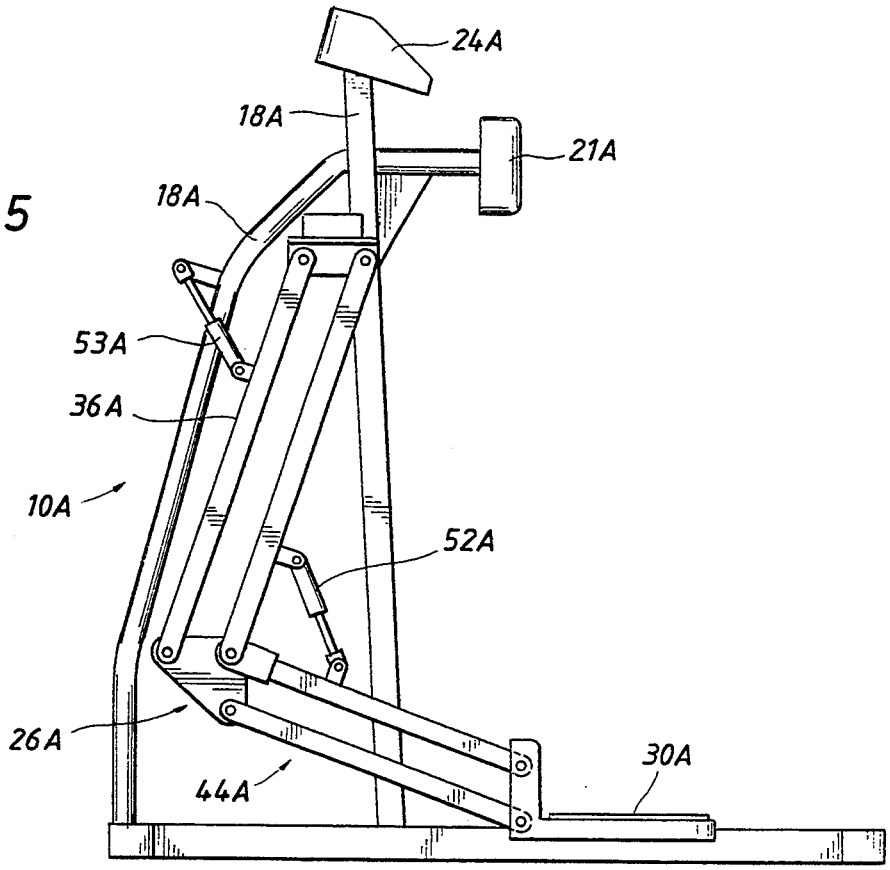
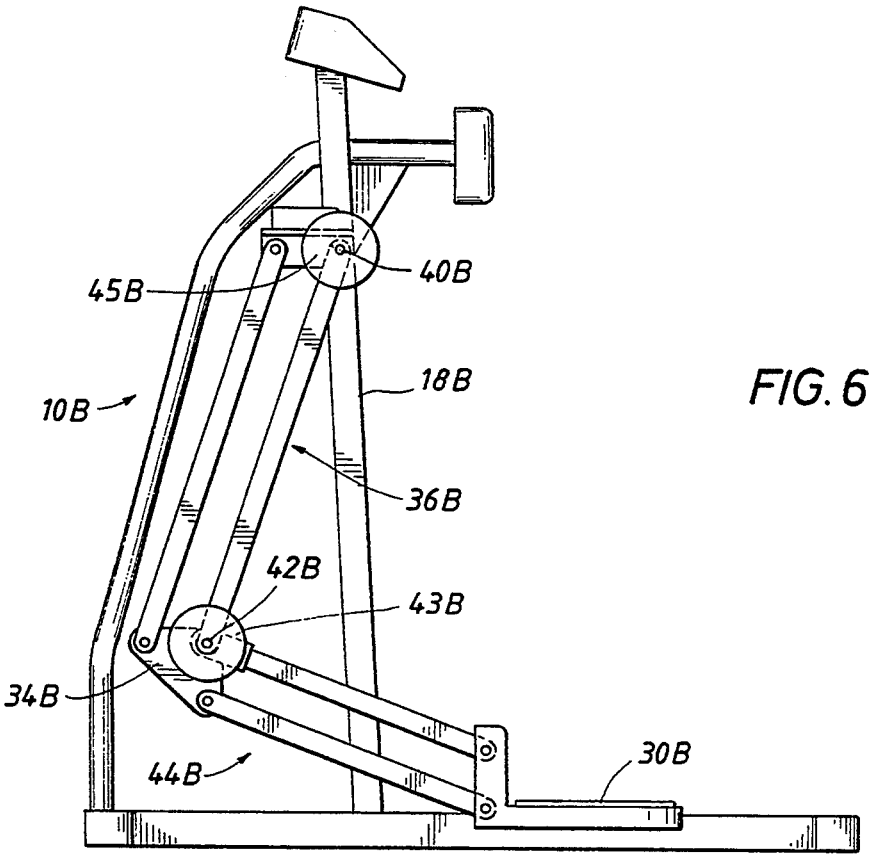
FIG. 6

FIG. 8
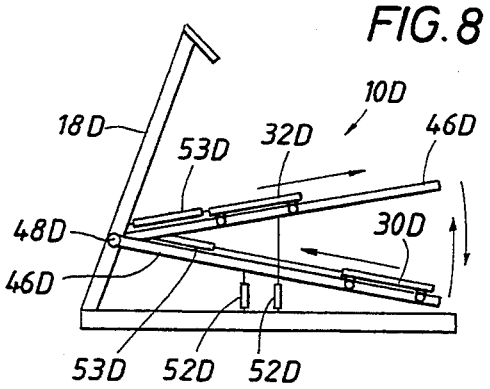
FIG. 9
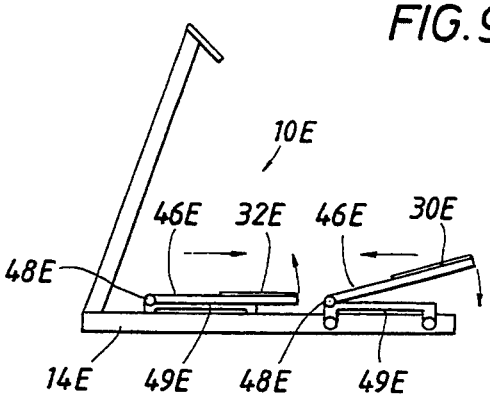
FIG. 10
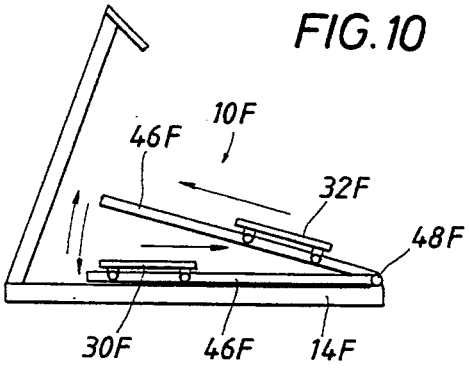
FIG. 11
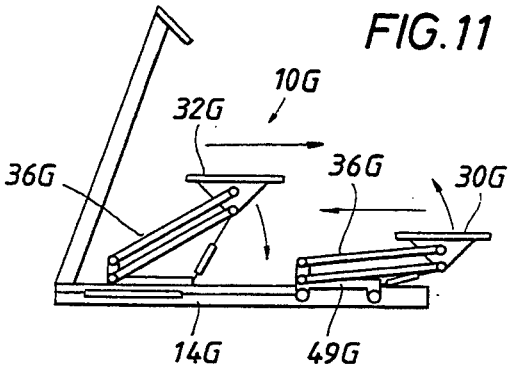
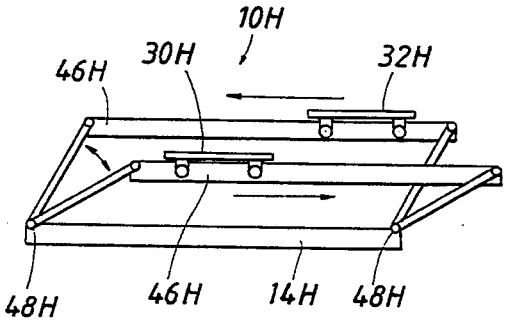
FIG. 12
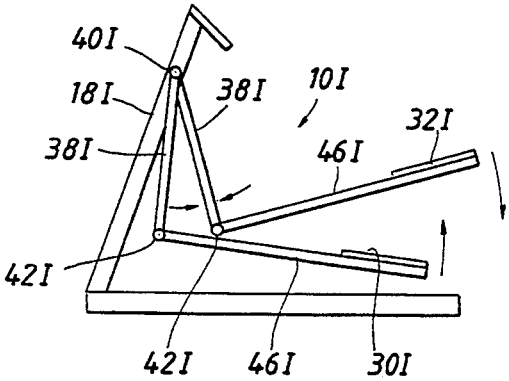
FIG. 13

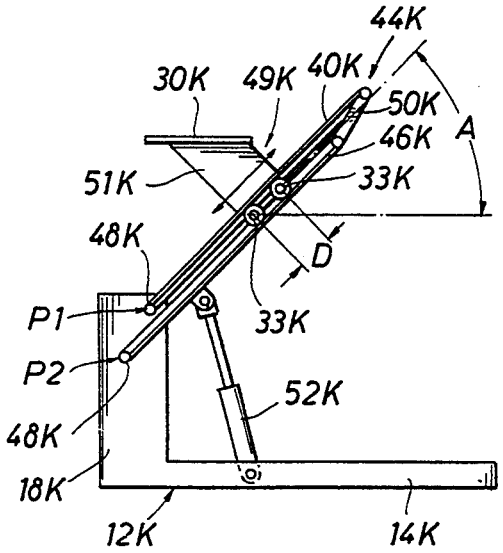
FIG. 16
FIG. 17
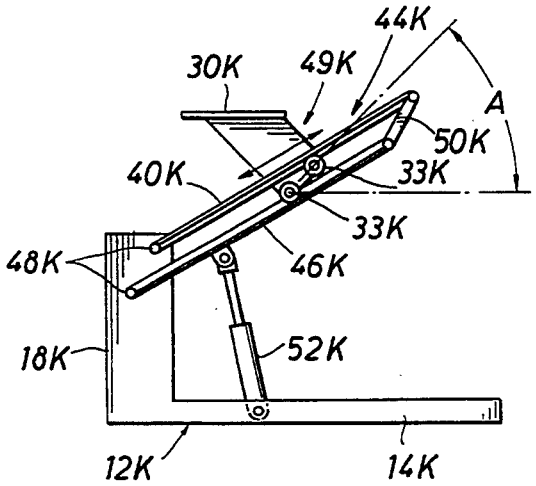
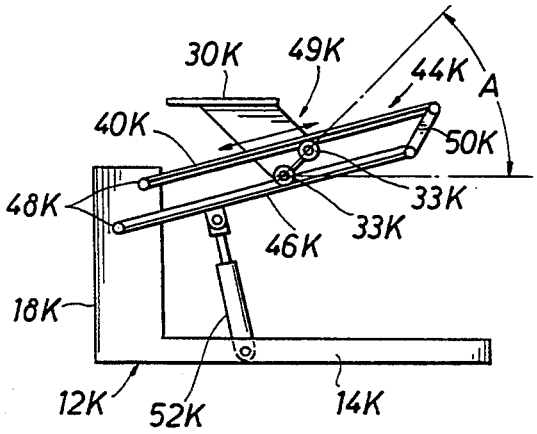
FIG. 18
FIG. 19
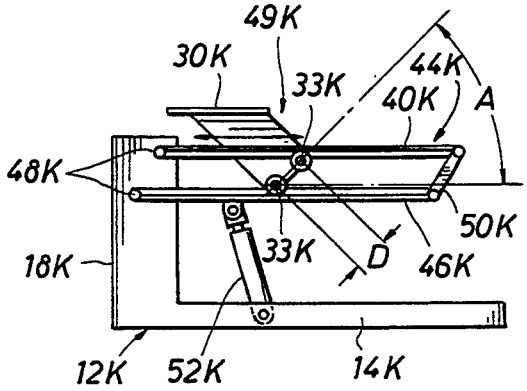

EXERCISE DEVICE

CROSS-REFERENCE TO RELATED APPLICATION

This application is a continuation in part of application Ser. No. 07/968,196, filed Oct. 29, 1992, now U.S. Pat. No. 5,290,211, and entitled Exercise Device.

BACKGROUND OF THE INVENTION

1. Field of the Invention

This invention relates generally to an exercise device. More particularly, the invention concerns an exercise device permitting a user to perform alternatively a stair stepping exercise or a cross country skiing exercise, or to perform a combined stair stepping exercise and a cross country skiing exercise.

2. Description of the Prior Art

Heretofore, various exercise devices have been provided to permit a user to perform a stair stepping exercise which simulates the climbing of stairs. Also, various exercise devices have been provided to permit a user to perform a cross country skiing exercise which simulates cross country skiing. However, none of the exercise devices heretofore have permitted in a single exercise machine, the simultaneous performance of a stair stepping exercise and a cross country skiing exercise. No prior exercise device has allowed a user to change the exercise he is doing while on the machine from stair climbing to cross country skiing to a bicycle-like motion to a backward walk motion, all without mechanical adjustment of the machine.

For example, U.S. Pat. No. 3,970,302 dated Jul. 20, 1976, shows an exercise device in which a pair of foot supports are mounted for movement along an inclined track to simulate stair climbing. A pair of shock absorbers connected to the foot supports resist downward movement resulting from a downward force exerted by the feet of a user and provide upward return movement of the foot supports to a predetermined position. There is no showing of an exercise movement simulating cross country skiing.

U.S. Pat. No. 4,685,666 dated Aug. 11, 1987, likewise shows an exercise device to simulate a climbing or stair stepping motion, but such exercise device does not provide a cross country skiing exercise.

U.S. Pat. No. 4,733,858 dated Mar. 29, 1988, shows a multi-purpose exercise device which may be utilized to perform various exercises. The device is used in a first position to practice climbing such as climbing steps. The device is adjusted to a second position to simulate a skating motion. There is no provision for performing a climbing exercise and a skating exercise simultaneously with the device remaining in one position.

U.S. Pat. No. 5,000,442 dated Mar. 19, 1990, shows a cross country ski simulator in which foot supports are mounted for generally horizontal back and forth movement with manually gripped handles controlling the movement of the foot supports and providing a resistance to the movement of the foot supports. Such ski simulator does not provide a simulated climbing or stair stepping exercise performed simultaneously with the cross country skiing exercise.

U.S. Pat. No. 5,195,935 dated Mar. 23, 1993 shows an exercise device in which the platform of the exercise machine is adjustable in inclination to an infinite number of angles by manipulation of switch means on a control panel for actuation of a motor. Thus a user is required to actuate a switch to change the inclination of the machine.

IDENTIFICATION OF OBJECTS OF THE INVENTION

It is an object of this invention to provide such an exercise device having a pair of foot supports movable in a generally vertical direction in a stair stepping exercise and movable in a generally horizontal direction in a cross country skiing exercise solely by changing the striding action exerted by the user against spaced foot supports without any separate adjustment of the exercise device.

A further object of this invention is to provide an exercise device having a pair of foot supports thereon which are mounted for simultaneous movement in combined horizontal and vertical directions while the foot supports remain in a horizontal plane.

An additional object of the invention is to provide an exercise device having a pair of foot supports mounted for combined generally vertical and horizontal movements with a force resisting member for each foot support in each direction.

Another object of this invention is to provide an exercise device in which a pair of foot supports are mounted on parallelogram linkages and remain in a horizontal position during raising and lowering of the linkages during performance of exercises.

SUMMARY

The invention is directed to an exercise machine or device which permits a user standing on foot supports to perform simultaneously a stair stepping or climbing exercise and a cross country skiing or skating exercise. The machine also permits alternative climbing or skiing exercises. The exercise machine includes a pair of foot supports on which the user stands to perform exercises. One preferred embodiment of the exercise machine includes a fixed support including a base and an upwardly extending support member. A linkage extends in a generally vertical direction between the fixed support and the foot supports.

Each foot support is operationally connected to force resisting means including a force resisting member for resisting downward movement of the foot support and, if desired, a separate force resisting member for resisting generally horizontal movement of the foot support. In preferred embodiments of the invention, the foot supports extend in a horizontal plane and remain in a horizontal plane during the entire exercise movement but are linked to the support member in a manner to permit exercise simulations as indicated above. The linkages between the support member and the foot supports may include four bar or parallelogram linkages.

In another preferred embodiment, a pair of horizontal support rails serves to support vertically and guide horizontally a pair of shuttle cars disposed thereon. Foot supports are pivotally linked to the shuttle cars. A force resistance means is connected between the foot support and each of the shuttle cars. In operation the foot supports may pivot with resistance with respect to the shuttle cars to produce a generally up and down motion similar to stair climbing. When a user stands on the foot supports, cross country skiing motion by such user is accommodated by reciprocating motion of the shuttle cars on the support rails. Simultaneous stair climbing and cross country skiing may be performed.

In a further embodiment, a foot plate assembly has a pair of lower support rollers mounted in tracks on a pair of vertically spaced parallel links for a cross country skiing exercise. The links extend in a generally horizontal direction but may be pivoted upwardly to vary the inclination for the foot plate assembly. The spacing between the links progressively decreases as the links are raised, but maintain the rollers in a fixed angular relation such that the foot support plate is maintained in a horizontal plane at all times.

BRIEF DESCRIPTION OF THE DRAWINGS

The objects, advantages and features of the invention will become more apparent by reference to the drawings which are appended hereto and wherein like numerals indicate like elements and wherein an illustrative embodiment of the invention is shown, of which:

FIG. 5 is a side elevation of an alternative embodiment of the exercise device of this invention in which fluid cylinders are provided for resisting the movement of the foot supports in a generally horizontal direction and for resisting the movements to foot supports in a generally vertical direction, with four bar linkages maintaining the foot supports in a generally horizontal plane;

FIG. 6 is a side elevation of another alternative embodiment of the exercise device of the present invention utilizing servo motors for controlling the movement of the foot supports without the use of a fluid cylinder to produce foot support movement in a generally horizontal direction and in a generally vertical direction;

FIGS. 8–13 are schematic views of other various embodiments of the exercise device of this invention in which foot supports are mounted for movement in a generally vertical direction for a stair stepping exercise and for simultaneous or single movement in a generally horizontal direction for a cross country ski exercise.

FIG. 16 is a schematic view of a further alternative embodiment of the exercise device of this invention in which a foot plate assembly is mounted on a four bar linkage track assembly for movement along the track assembly; and FIGS. 17–19 show the track assembly of FIG. 16 in different angular relationships relative to a fixed support.

DESCRIPTION OF THE INVENTION

Figure 1:
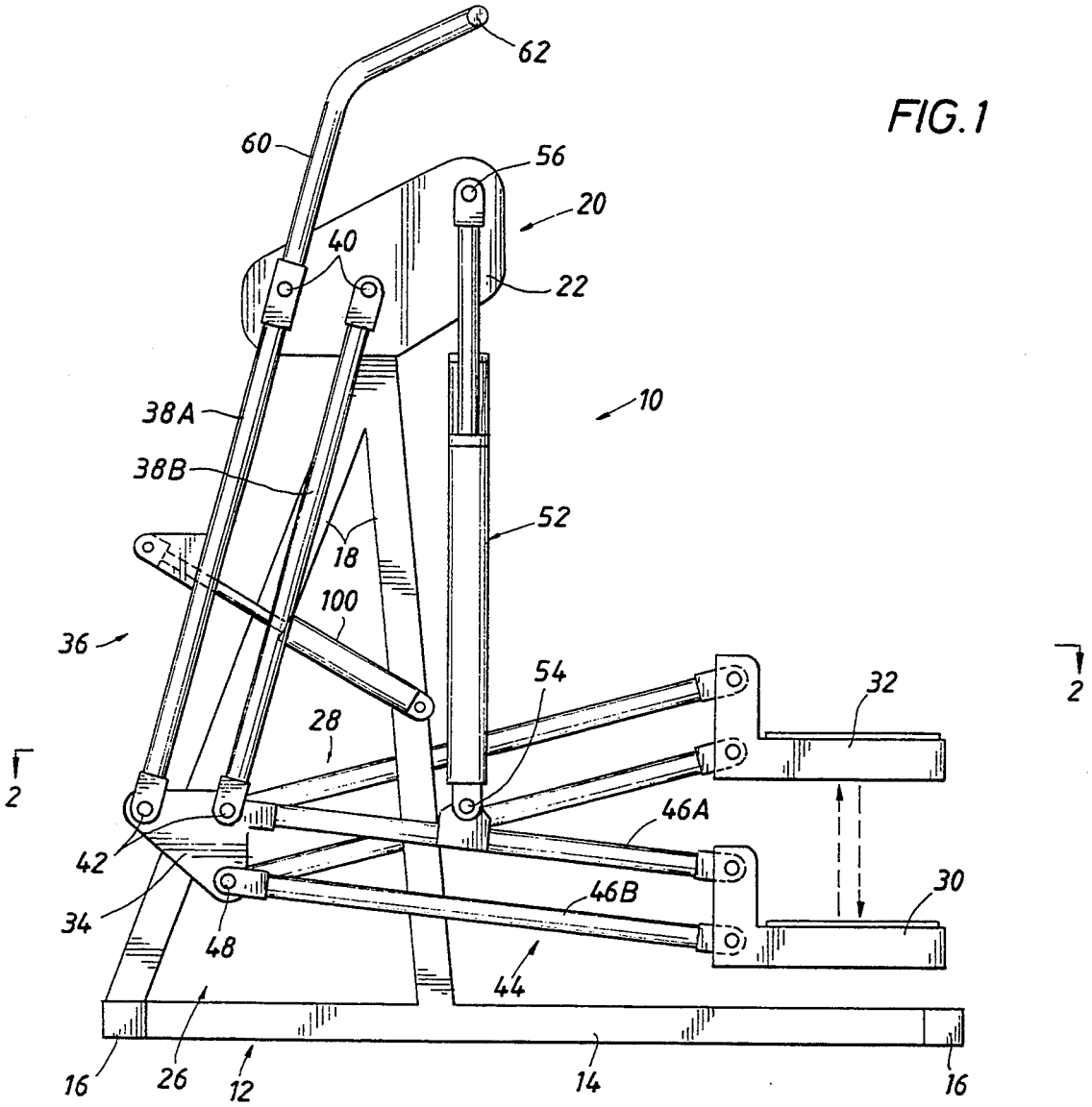
FIG. 1 is a side elevation of an embodiment of the exercise device of this invention for a combined stair stepping exercise and a cross country skiing exercise in which a fluid cylinder resists up and down motion of foot supports in the climbing mode and acts as a link in the support between the frame and the supports to enable skiing motion.
Figure 2:
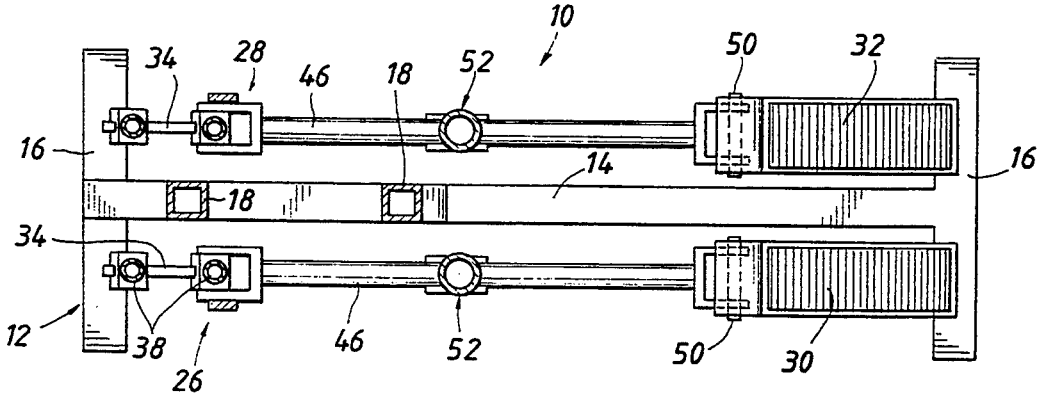
FIG. 2 is a plan view of the exercise device of FIG. 1 taken generally along the line 2—2 of FIG. 1.

Referring now to the drawings showing the embodiment of FIGS. 1–4, the exercise device generally indicated at 10 has a fixed support frame indicated generally at 12. Fixed support frame 12 includes a base support member 14 having end frame members 16 connected thereto and adapted for support by a floor. Upwardly extending frame member 18 supports an upper mounting head generally indicated at 20. Mounting head 20 includes a pair of opposed plates or side support members 22. A control panel 24 is provided between support members 22 for visually displaying performance data and the like as may be desired.

Linkage support frames 26 and 28 are pivotally supported from opposed side support members 22. Frames 26 and 28 include multiple pivoted links. Linkage support frame 26 includes a pivoted foot support 30. Linkage support frame 28 includes a pivoted foot support 32. The foot support 30 supports the left foot of a user; foot support 32 supports the right foot of a user.

Linkage support flames 26 and 28 are both shown in FIGS. 1–4, but only support frame 26 is described in detail, because support frame 28 is generally identical to support frame 26. Linkage support frame 26 includes a lower connecting plate or bracket 34. A four bar or parallelogram linkage generally indicated at 36 extends in a generally vertical direction between side support member 22 and connecting plate 34. Linkage 36 includes a pair of links 38A, 38B pivotally mounted at 40 to side support member 22 at their upper ends and pivotally connected at 42 to connecting plate 34 at their lower ends. A four bar or parallelogram linkage 44 extends in a generally horizontal direction between connecting plate 34 and foot support 30. The four bar linkage 44 includes a pair of links 46A, 46B pivotally connected at 48 to connecting plate 34 and pivotally connected at 50 to foot support 30.

Downward movement of foot support 30 is resisted by fluid cylinder 52 which is pivotally mounted at its lower end at 54 to upper link 46A of linkage 44 and pivotally mounted at its upper end at 56 to side support member 20. Fluid cylinder 52 cushions the downward movement of foot support 30 from the weight of the user thereon. Cylinder 52 is preferably a combined damping mechanism and spring. Upon release of the weight of the user the spring of cylinder 52 returns foot support 30 to its upper position. The spring loading may be manually adjusted for determining the return movement. The resistance to the downward motion of foot support 30 from fluid cylinder 52 increases with downward velocity due to the damping mechanism of cylinder 52.

Operation in the Stair Climbing Mode

FIG. 1 illustrates the condition of the exercise machine 10 in the stair climbing mode where the left foot of a user has pushed foot support 30 to a downward position. Natural action of the user takes force off of foot support 32 and it rises to the position shown under the upward spring force of a right hand side fluid cylinder 52.

For a solely stair stepping exercise, a user may wish to support himself by holding on to support plates 22 or to an auxiliary stationary bar (not shown) arranged for safety and stability during such exercise. Such bar may be fastened to base support member 14.

Figure 3:
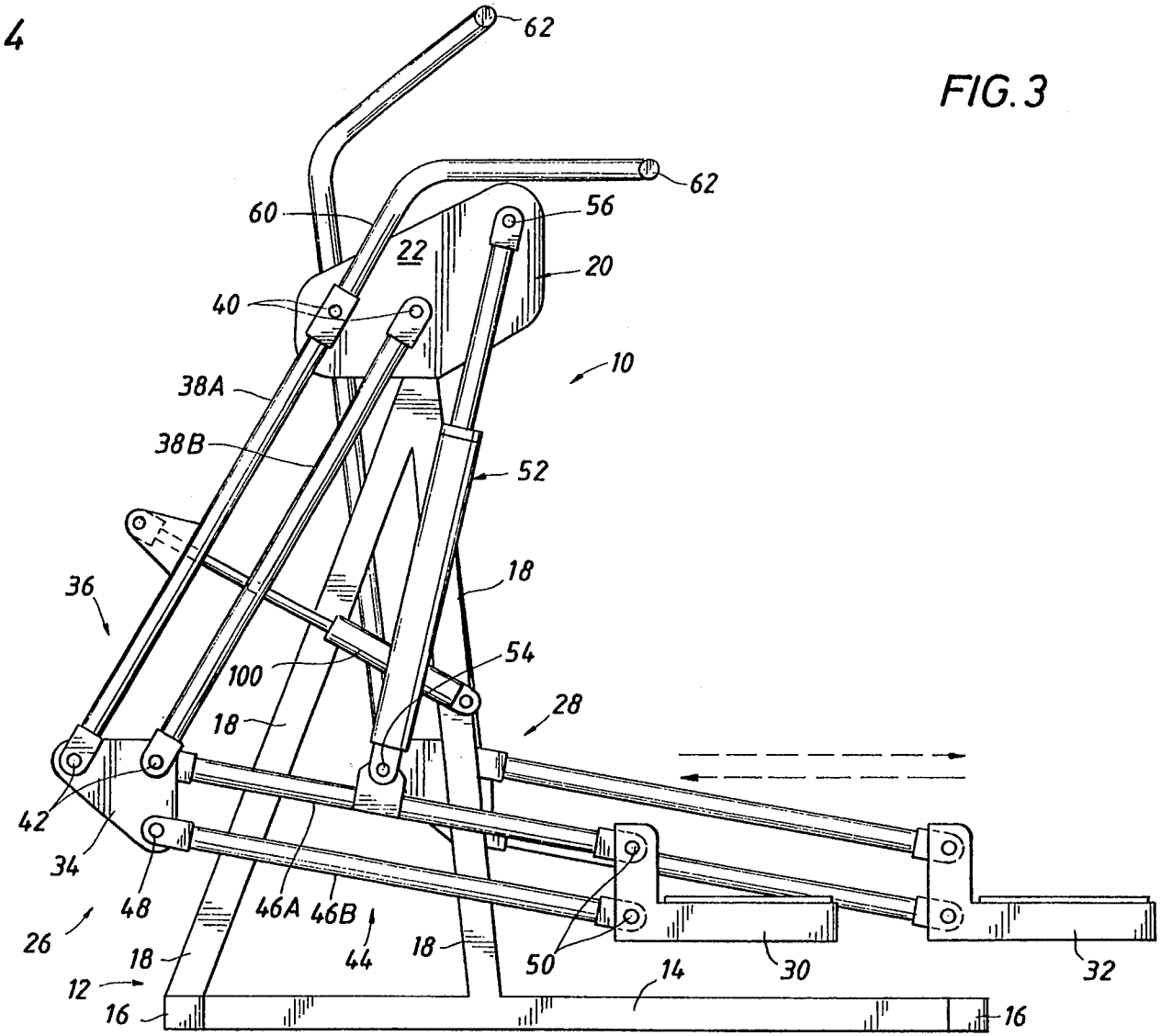
FIG. 3 is a side elevation of the exercise device similar to FIG. 1 but showing the foot supports moveable in a generally horizontal direction to simulate cross country ski motion.

At the lower position shown for foot support 30, the fluid cylinder 52 completely "strokes out" such that fluid cylinder 52 acts as a pivoted link between top support plate 22 and link 46A of linkage 44. Accordingly, in order to shift into a purely skiing exercise, the user stands on both foot supports 30 and 32 such that both of their fluid cylinders completely "stroke out" and the machine 10 is ready for horizontal skiing exercise as shown in FIG. 3.

Handles for Skiing Exercise

Figure 4:
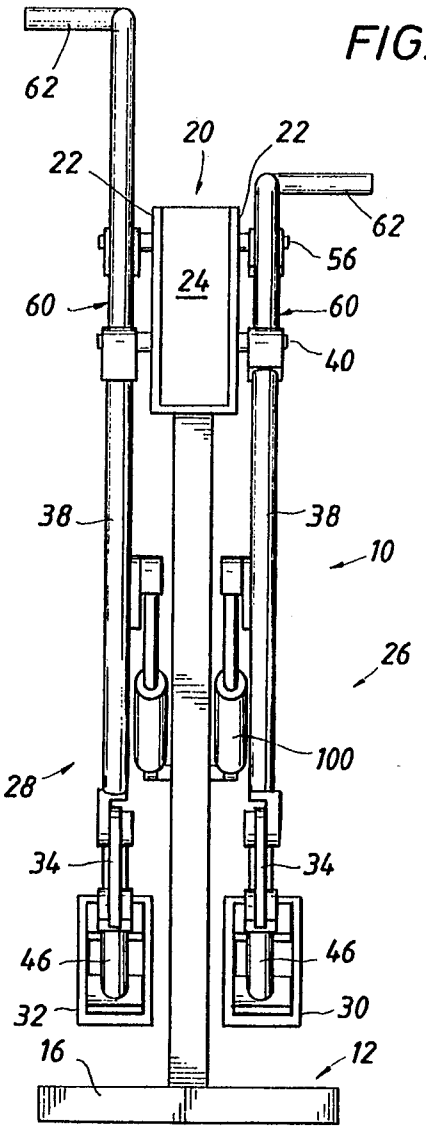
FIG. 4 is a front elevation of the exercise device shown in FIG. 3.

Left and right handles 60 are provided with upper hand grips 62 to aid a user when the machine is used in the skiing mode. FIGS. 1, 3 and 4 illustrate the preferred design of attaching handles to the outer link 38A of four bar linkage 36. Handles 60 may be fixed to link 38A by welding or other means such as screws or nuts and bolts. If desired, a force resisting means such as a spring and damper cylinder 100 may be placed between handle 60 and frame member 18 to resist backward and forward motions of the foot supports 30, 32. (Other force resisting means useful in the exercise machine art may be substituted for cylinder 100.)

Such force resisting means 100 may not be needed in that the very act of a user shifting his weight in a forward and backward motion may offer sufficient exercise not to require further force resisting means. For that reason, fluid cylinder 100 may be shown in dashed lines to indicate that it may be installed when desired, or alternatively that it might not be necessary for proper skiing simulation. Of course, another fluid cylinder 100 (or other force resisting means) is installed on the right-hand side between link 38A and frame member 18. Either the skiing mode or the stepping mode may have a mechanism to provide dependent operation between the left and right foot supports. Such mechanism may include a cable and pulley arrangement connected between the right and left linkages which causes the left foot support to move upwardly when the right foot support is forced downwardly and vice versa. A similar mechanism may be provided for forward and backward movement of the foot supports.

Design of Linkages to Allow Horizontal Movement of Foot Supports

As best illustrated in FIG. 3, foot supports 30 and 32 may be moved in substantially horizontal forward and rearward direction while being suspended from mounting head 20 by linkage 26. In such skiing mode, the fluid cylinders are completely "stroked out" and serve as an intermediate link between mounting head 20 and arm 46A of link 44.

The linkage 36 is a four bar pivoted linkage between head 20 and connecting plate 34. The linkage 44 is a four bar pivoted linkage between connecting plate 34 and foot support 30. (The right-hand side has similar linkages to foot support 32). The stroked out cylinder 52 forms a pivoted linkage between mounting head 20 and linkage 44. Such stroked out cylinder 52 forms still a third four bar linkage with head 20 and links 36 and 44. By appropriate adjustment of the lengths of links 36, 44 and stroked out cylinder 52 and by appropriate connection placement of cylinder 52 at head 20 and link 46A, the foot supports 30 and 32 may be constrained to move in a substantially horizontal backward and forward position, all the while being suspended from head 20 and requiring no connection on a track or the like.

Operation in the Skiing Mode

A user stands on both foot supports 30 and 32 to completely stroke out the fluid cylinders 52. The user then begins a shuffling skiing type motion while holding left and right handles 62. (Such motion is also similar to skating.) As the left hand foot support 30 moves forward, the left handle 62 moves rearward and up because of its connection to link 38A. As the left hand foot support 30 moves rearward, the left handle 62 moves forward and down. Such handles simulate the motion of ski poles manipulated by an actual skier.

Operation in Multiple Modes

The exercise machine 10 of FIGS. 1–4 may be operated in a mixed mode so that a combination of stair stepping and skiing motion may be simulated. In a forward direction, running, walking, or cycling type motions may be simulated. Such running motion is simulated (similar to that of a treadmill) without any impact at all on the user's knees, hips or feet. Reverse running motion may also be simulated.

Alternative Embodiments

Referring to FIG. 5, an alternative exercise device indicated at 10A is shown schematically with linkage support 26A including an upper four bar linkage 36A and a lower four bar linkage 44A. (Only the left-hand side of the exercise device is illustrated. A similar right-hand side of the machine is provided, but it is not illustrated here, for simplicity.) A foot support 30A is mounted on one end of four bar linkage 44A. Resistance to movement of foot support 30A in a generally vertical direction is provided by a fluid cylinder 52A connected between lower four bar linkage 44A and upper four bar linkage 36A. Resistance to generally horizontal movement of foot support 30A may be provided (if desired) by fluid cylinder 53A extending between four bar linkage 36A and upright frame member 18A. An abdominal pad 21A is secured to fixed support frame member 18A to support the abdomen of a user. A control box 24A is mounted on the upper end of fixed support frame member 18A to provide to the user a visual observation of his performance from sensors (not shown) mounted on the machine. No manually operated handles are provided in the embodiment of FIG. 5, although such handles, similar to those of FIGS. 1–4 could be provided if desired.

Another embodiment of the exercise device of this invention is illustrated at 10B of FIG. 6. It is similar to the exercise device 10A of FIG. 5 except in regard to the force resisting members resisting the vertical and horizontal movements of foot support 30B. Four bar linkages 36B and 44B are provided. A connecting plate 34B includes a pivot 42B for linkages 36B and 44B. Pivot 40B is provided for four bar linkage 36B mounted on fixed vertical support frame member 18B. A servo motor 43B is provided to control the pivotal movement of pivot axis 42B. Another servo motor 45B is provided to control the pivotal motion of pivot 40B. Thus, servo motor 43B may be used to provide a resisted force to the generally vertical movement of foot support 30B. Servo motor 45B may be used to resist the generally horizontal movement of foot support 30B. Servo motors 43B and 45B may be adjusted to provide the desired resistance. Alternatively, servo motors may provide a programmed motion, either stair climbing or skiing or any combination of both motions for physical rehabilitation of a patient.

Figure 7:
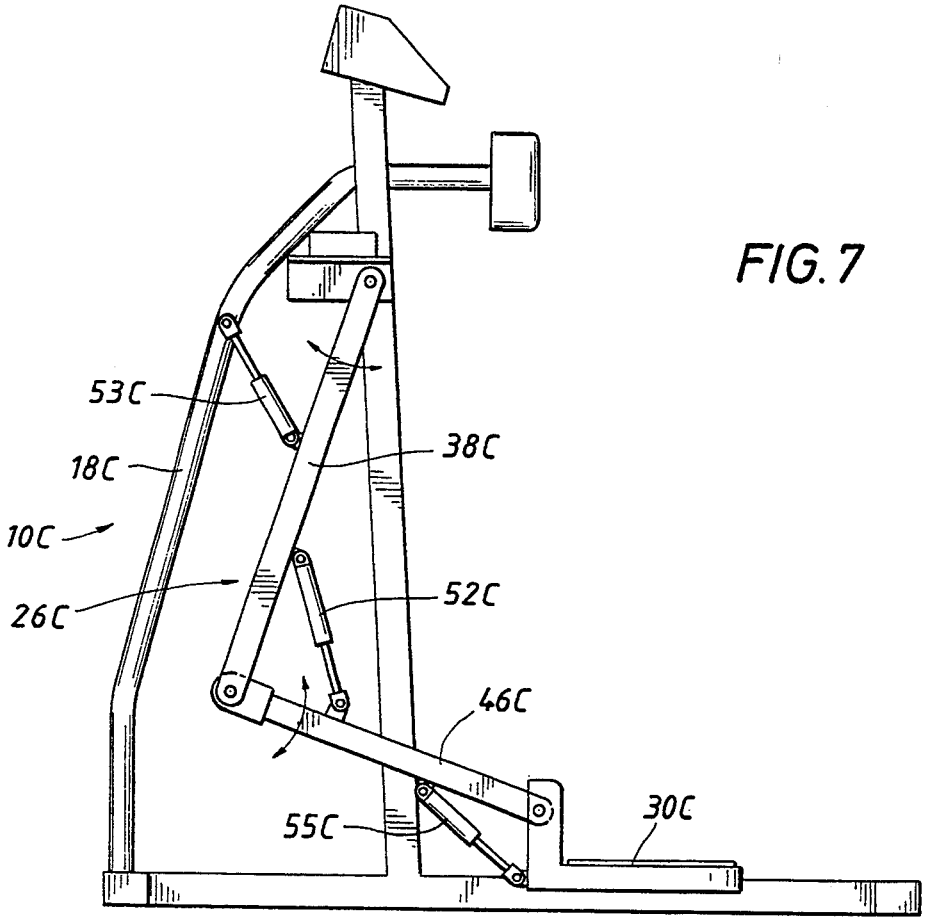
FIG. 7 is a side elevation of another alternative embodiment of the exercise device of this invention similar to the embodiment of FIG. 6 but eliminating certain four bar links while utilizing fluid cylinders for resisting the horizontal and vertical movements of the foot support and having a fluid cylinder connected to the foot support for maintaining the foot support in a generally horizontal plane.

Referring now to FIG. 7, an exercise device of this invention is shown at 10C. Linkage support frame 26C includes an upper link 38C and a lower link 46C. An upper fluid cylinder 53C extends between link 38C and fixed support frame member 18C to control the horizontal movement of foot support 30C. Fluid cylinder 52C controls the generally vertical movement of foot support 30C and is connected between links 38C and 46C. To maintain foot support 30C in a generally horizontal plane, fluid cylinder 55C is pivotally mounted between link 46C and foot support 30C. The providing of a separate fluid cylinder 55C to maintain foot support 30C in a generally horizontal plane eliminates the necessity of having four bar linkages as in the embodiments shown in FIGS. 1–4, FIG. 5, and FIG. 6. Other satisfactory force resisting devices could be provided such as servo motors, for example.

FIGS. 8–13 are schematic views of further embodiments of the exercise device in accordance with the present invention in which foot supports 32 (D,E,F,G,-H,I) are moveable simultaneously in a stair stepping exercise and in a cross country skiing exercise with a force resisting device for resisting generally vertical movement for the stair stepping exercise and a separate force resisting device for resisting generally horizontal movement for the cross country skiing exercise. For example, as shown in FIG. 8, exercise device 10D has foot supports 30D and 32D mounted for sliding movement on links 46D which are pivotally mounted at 48D to fixed frame member 18D. To resist generally horizontal movement of foot supports 30D and 32D, force resisting devices 53D may be provided if desired. To resist generally vertical movement of foot supports 30D and 32D, force resisting devices 52D are provided. Such force resisting devices are similar to those of FIGS. 1–4.

The term "simultaneous" or "simultaneously" as used in the specification and claims herein relative to a stair stepping exercise and a cross country skiing exercise is to be interpreted as a combined exercise performed within a continuous time period by changing the striding actions exerted by the feet of a user against spaced foot supports without any separate adjustment of the exercise device.

The exercise machines of FIGS. 9–13 are not shown with force resisting devices of members thereon. Such force resisting devices include at least a spring to force a foot assembly to an upper or return position when a user does not apply weight to such foot assembly. Such force resisting member preferably, but not necessarily, includes a damper which includes a fluid cylinder which provides increased resistance to the downward motion of a foot support with increases of downward velocity. However, it should be understood that force resisting devices similar to those in the embodiment of FIG. 8 would be used for the embodiments of FIGS. 9–13. Referring to FIG. 9, foot supports 30E and 32E are mounted on link arms 46E which, in turn, are pivotally mounted at 48E to carriages 49E which are mounted for horizontal movement along fixed base frame member 14E.

FIG. 10 shows an embodiment in which foot supports 30F and 32F are mounted for sliding movement along link arms 46F which, in turn, are pivotally mounted at 48F to base frame member 14F. FIG. 11 shows an alternative preferred embodiment 10G of the invention having foot supports 30G and 32G mounted on four bar linkages 36G which, in turn, are pivotally mounted on a shuttle car or carriage 49G for horizontal movement along base frame member 14G. A more detailed description of the embodiment of FIG. 11 is described below in conjunction with FIG. 14.

FIG. 12 shows exercise device 10H having foot supports 30H and 32H mounted for sliding movement along an upper link 46H of a four bar linkage which is pivotally connected by rear and forward pivots at 48H to a base support member 14H. FIG. 13 shows an embodiment 10I in which foot supports 30I and 32I are mounted on links 46I which are pivotally connected at 42I to links 38I. Links 38I are pivotally connected at 40I to fixed vertical support frame member 18I.

Alternative Low Profile Embodiment of the Invention

Figure 14:
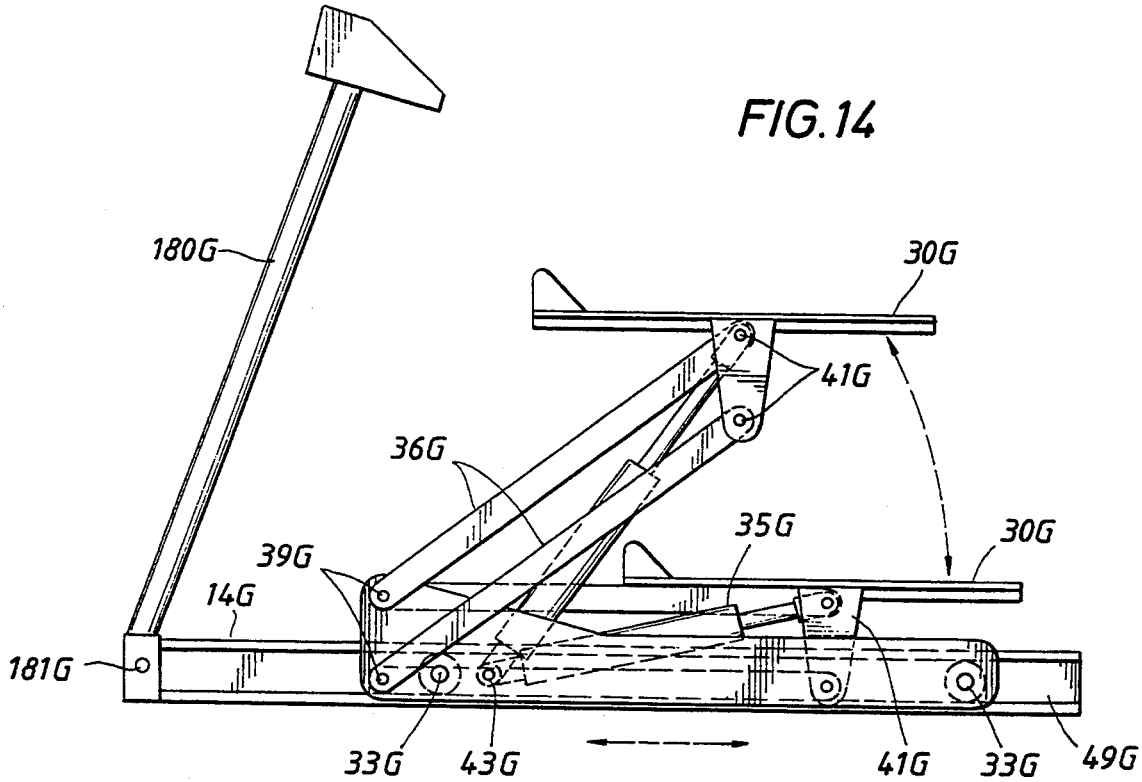
FIG. 14 is a detailed illustration of an alternative low profile embodiment of the invention.

FIG. 14 shows in more detail an alternative preferred embodiment of the invention in which a pair of rails 14G vertically support and horizontally guide a pair of foot supports 30G. In the view of FIG. 14, only one support is shown in its up and down positions, but an identical foot support and rail is placed on the other side of the ones shown.

Rollers 33G are secured to shuttle cars 49G and fit within a guide groove 47G of rails 14G. Brackets 41G are secured between foot supports 30G and shuttle car 49G. Accordingly, when a user stands on foot supports 30G and alternately moves his legs in forward and backward directions, shuttle carriage 49G moves forward and backward as it is guided by rollers 33G within guide grooves 47G of rails 14G.

Links 36G are connected by pivots 41G to bracket 41G and by pivots 39G to the forward end of shuttle car 49G. Links 36G are preferably parallel to each other so as to create a four bar linkage between the foot supports 30G and the shuttle cars 49G. A force resisting means 35G is connected between bracket 41G at one of the pivots 41G to another pivot 43G on shuttle car 49G. Such force resisting means preferably includes a spring and preferably a damper to increasingly resist downward motion as a function of increasing downward velocity.

Such damper of force resisting means 35G may be adjustable to provide variable resistance. The springs of force resisting means 35 forces foot support 30G to an upward position when the user is not standing on it. The damper and the spring of force resisting means 35G may be separate items, but preferably they are in an integral "shock absorber" as illustrated in FIG. 14. Alternatively, a spring return may not be desired for independent action of each foot support 30G; in that case, left and right foot supports are interconnected by means of a pulley arrangement or the like such that as the left foot support is forced downwardly, the right foot support moves upwardly and vice versa.

The alternative preferred embodiment of FIGS. 11 and 14 allows the same simultaneous stair climbing and cross country skiing exercises as that shown in the embodiment of FIGS. 1–4. It has the advantage of a lower vertical profile, especially where support 180G may be folded down about pivot 181G with the result that the exercise device may be stored in less vertical space.

Alternative Arrangement for Poles for Stepping Exercise

Figure 15:
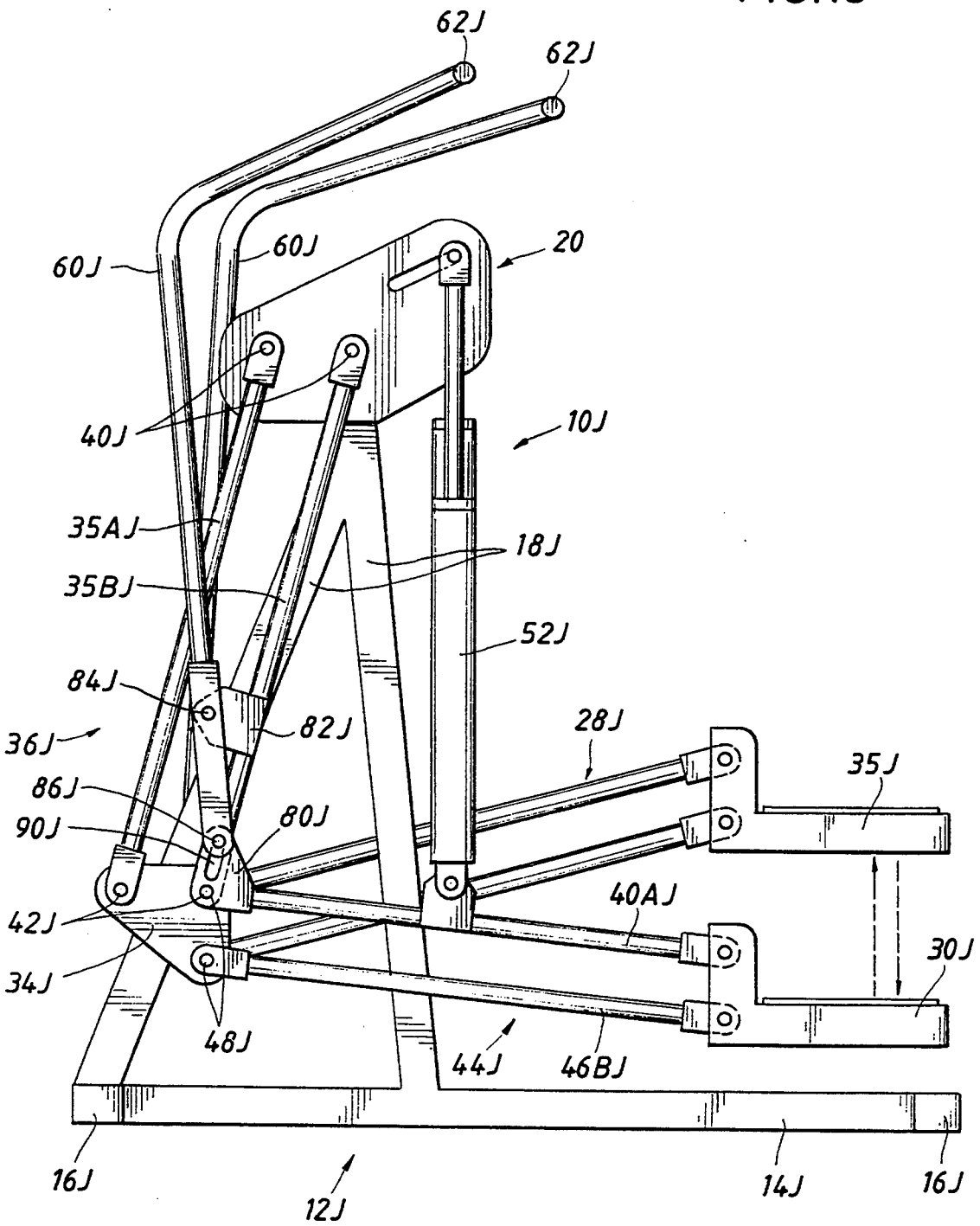
FIG. 15 illustrates an alternative embodiment for connection of handles to the exercise device for a stair climbing exercise.

FIG. 15 illustrates an alternative embodiment of the invention of an exercise device 10J similar in arrangement to that of FIGS. 1–4, but with an alternative connection of poles 60J to the linkage 36J which links foot supports 30J and 32J to support 20J. The left hand pole 60J is connected by a pivot 84J to bracket 82J fastened to link 35BJ. Pole 60J includes a bar 86J secured for motion within slot 90J of bracket 80J which is pivoted to connecting plate 34J. Cylinder 52J is mounted between link 40AJ and support 20J. The right hand handle 60J is connected (the connection is not shown) in a corresponding way to link 35BJ on the right hand side of the exercise device 10J. Fixed support frame 12J includes a base support member 14J, end support member 16J, and upwardly extending frame members 18J which support upper support 20J.

The alternative arrangement of poles 60J and their connections to links 35BJ enable them to move rearwardly when its associated foot support moves up and vice versa. With reference to FIG. 15, as support 30J moves up, link 40AJ pivots upwardly about pivot 42J causing bracket 80J to pivot counterclockwise. Such rotation of bracket 80J causes pole 60J to rotate clockwise about pivot 84J in bracket 82J while the end of pole 60J slides downwardly with its link 86J in slot 90J. Opposite motions occur when the foot support moves downwardly. The arrangement of the handles of FIG. 15 causes them to move in a sympathetic manner with the natural movement of human arms when climbing stairs. In other words, as a user's left foot pushes downwardly his left arm naturally rises and vice versa.

Alternative Arrangement for Skiing and Stair Stepping Exercises

Referring now to FIGS. 16–19, a further embodiment of the exercise device is shown in which a four bar track or parallelogram assembly shown generally at 44K is provided to maintain foot support 30K in a horizontal portion at all times during the exercise. A fixed support frame 12K includes a base support member 14K and an upwardly extending frame member 18K. Four bar track assembly 44K is mounted about horizontal pivots 48K on one side of upwardly extending frame member 18K. A similar four bar track assembly (not shown) is mounted on the opposite side of upwardly extending frame member 18K for another foot support.

Four bar track assembly 44K includes a pair of upper and lower links 40K and 46K pivoted at one end to pivots 48K on upper frame member 18K. An end link 50K is pivotally connected between the outer ends of links 40K and 46K to form a parallelogram linkage. A force resisting means 52K is pivotally connected between base support member 14K and lower link 46K to provide a resistance against downward movement and to return the linkage 44K to a rest position as shown in FIG. 16 upon release of the downward force. Such force resisting means 52K preferably includes a spring and a damper in one integral unit as illustrated.

Foot support 30K is mounted on the upper end of a foot support assembly or trolley indicated generally at 49K and has a pair of wheels or rollers 33K along the lower end thereof defining guide members for foot support assembly 49K. A foot retention means may be provided on foot support 30K similar to that shown on foot support 30G of FIG. 14.

Each link 40K, 46K of assembly 44K defines a track or guide which receives associated roller 33K therein for movement along the respective link. A bracket plate 51K on support assembly 49K has rollers 33K mounted thereover for rotation about the lower end thereof and has foot support plate 30K on its upper end. Rollers 33K are spaced by plate 51K from each other at a fixed constant distance D. The angular relation of rollers 33K relative to each other with respect to the horizontal is constant throughout the entire movement of links 40K, 46K as shown by angle A in FIGS. 16–19. In some instances, it may be desirable to connect a force resisting device to trolley 49K to resist movement thereof along links 40K, 46K. It may also be desirable to drive linkage assembly 44K or support assembly 49K with a motor to achieve active motion of the device for rehabilitation purposes for example.

As explained previously with other embodiments of this invention, mechanisms may be provided to interconnect each foot support 30K of the pair of foot supports so as to cause forward movement of one foot support when the other foot support is moved to the rear and/or causing upward movement of one foot support when the other foot support is depressed. Such mechanisms may include cable and pulley arrangements (not shown) connected between the two foot supports 30K.

In one operation, the exercise is commenced from the rest position shown in FIG. 16 with the feet of the user on foot support members or plates 30K. The weight of the user causes downward movement of linkage 44K and foot support assembly 49K to the position of FIG. 19 if the weight of the user is not released by lifting of the foot of a user. In the position of FIG. 19 a cross country skiing exercise may be simulated with movement of the feet of the user in a horizontal direction while maintaining the user's weight on foot support members 30K. Release of such weight from foot support assembly 49K effects upward movement of linkage 44K by force resistance means 52K to a position such as illustrated in FIGS. 17 and 18 for a stair stepping exercise or combined stair stepping and cross country skiing exercise. As the four bar track assembly pivots downwardly about pivots 48K from the rest position of FIG. 16, the spacing between links 40K and 46K progressively increases with angle A remaining constant, thereby maintaining foot support 30K in horizontal relation as shown in FIGS. 16–19 at all positions. FIG. 18 shows links 40K, 46K extending at an angle of about 30 degrees with respect to the horizontal, while FIG. 16 shows links 40K, 46K at an angle of around 45 degrees with respect to the horizontal. The spacing between links 40K, 46K decreases progressively as track assembly 44K moves upwardly and is designed to maintain guide rollers 33K at a constant angular relationship to each other relative to the horizontal as shown by angle A. Such angular relationship is maintained throughout the travel of wheels 33K along the tracks or guides in links 40K, 46K. The tracks may, for example, be similar to those of FIG. 14. Also, if desired, a pair of opposed tracks with pairs of rollers therein may be provided for each link 40K, 46K to provide increased balance and stability for foot support 30K. Operationally, a user may change from a stair stepping exercise to a cross country skiing exercise solely by changing his striding action exerted through his feet against foot supports 30K without any separate adjustment of the exercise device being required.

If desired the linkages 40K, 46K may be fixed in any angular orientation with respect to the horizontal base plate 14K. So fixed, the trolley 49K may move up and down the incline (or back and forth on a horizontally fixed guide assembly 44K) under the operation of a user, yet the foot plate 30K remains in a horizontal position. Accordingly, this embodiment of the invention allows simulation of climbing or skiing at a fixed angle of incline, yet the foot supports remain horizontally oriented for any angle of incline for ease of operation.

While preferred embodiments of the present invention have been illustrated in detail, it is apparent that modifications and adaptations of the preferred embodiment will occur to those skilled in the art. For example, although several embodiments of the invention have been illustrated it should be apparent to routineers in the art of exercise equipment design that other support structures than the floor support members of FIGS. 1–6 are possible. A wall support or even a support from an overhead structure could be used with the foot supports and linkages of the invention. It is to be expressly understood that such modifications and adaptations are within the spirit and scope of the present invention as set forth in the following claims.

What is claimed is:

1. An exercise device for permitting a stair stepping exercise in a generally vertical direction or a cross country skiing exercise in a generally horizontal direction, said exercise device comprising:

a base support;

a pair of spaced foot supports for supporting the feet of a user in a generally upright position;

linkage means operatively connected between said foot supports and said base support for mounting said foot supports for movement in a generally vertical movement simulating a stair stepping exercise or a generally horizontal movement simulating a horizontal skiing exercise, either exercise to be performed at the discretion of the user by changing the striding action exerted through the feet of the user against said spaced foot supports; and force resisting means for resisting movement of said foot supports.

2. An exercise device as set forth in claim 1 further comprising:

separate force resisting means for each of said foot supports.

3. An exercise device as set forth in claim 2 wherein:

said separate force resisting means for each of said foot supports comprises a force resisting device to resist downward movement of the associated foot support, and to return such foot support to an upper position when a user is not applying downward force to it.

4. An exercise device as set forth in claim 1 further comprising a handle operatively connected to the associated foot support and adapted to be gripped manually by a user during said horizontal skiing exercise.

5. An exercise device as set forth in claim 1 wherein said means operatively connected between said foot supports and said base support includes a generally horizontal linkage connected to said foot support, and a generally vertical linkage pivotally connected at its lower end to said horizontal linkage and pivotally connected at its upper end to said base support; and said force resisting means comprises a force resisting device operatively connected to said generally horizontal linkage to resist downward movement thereof.

6. The exercise device of claim 5 wherein said force resisting device is a fluid cylinder having a damper and spring to resist downward force on said foot support, where said spring returns such foot support to an upper position when a user is not applying downward force to it.

7. The exercise device of claim 6 wherein:

said fluid cylinder is operatively arranged between said base support and said generally horizontal linkage so that when said fluid cylinder is fully stroked out due to a user's downward force on it, said fluid cylinder acts as a link in a support mechanism between said foot support and said support base to produce a substantially horizontal back and forth movement of said foot support as a user simulates a skiing movement.

8. An exercise device for providing a stair stepping exercise or horizontal skiing exercise, or for permitting a combined stair stepping exercise in a generally vertical direction and a cross country skiing exercise in a generally horizontal direction, said exercise device comprising:

a base support;

a pair of spaced foot supports for supporting the feet of a user in a generally upright position;

linkage means operatively mounting said spaced foot supports for movement in a generally vertical direction to simulate a stair stepping exercise and movement in a generally horizontal direction to simulate a cross country skiing exercise, said linkage means operatively arranged to permit said stair stepping exercise or said cross country skiing exercise to be performed at the discretion of the user by changing the striding action exerted through the feet of the user against said spaced foot supports; and resistance means operatively connected between said foot supports and said base support for separately resisting the downward movement of each of said foot supports upon a downward force exerted against an associated foot support and returning said foot support to a rest position upon release of said downward force.

9. An exercise device as set forth in claim 8 wherein:

said means operatively connected between said foot supports and said base support includes a generally horizontal linkage connected to said foot supports; and said resistance means comprises a fluid cylinder device operatively connected to said foot supports to resist downward movement thereof.

10. An exercise device for permitting a range of paths of motion for the user's feet, said exercise device comprising:

a base support;

a pair of spaced foot supports for supporting the feet of a user; and linkage means operatively connected between said foot supports and said base support for mounting said foot supports for selective movement along paths of motion including a generally vertical movement and a generally horizontal movement, said linkage means operatively arranged to allow a user to select a path of motion by changing the force exerted through the feet of the user against said spaced foot supports.

11. An exercise device comprising:

support means including a fixed support member;

a parallelogram linkage having a pair of spaced generally parallel links pivotally mounted about horizontal axes on said fixed support member and extending outwardly from said fixed support member, said parallel links defining a pair of spaced guides remaining in a parallel relation to each other during pivotal movement of said links;

a foot support assembly having a foot support member extending in a generally horizontal direction and a pair of spaced guide members in translatory engagement with said pairs of spaced guides; and resistance means operatively connected to said linkage for resisting the pivotal movement of said linkage and foot support assembly thereon;

said linkage capable of being pivoted from a position in which said pair of links extend in a generally horizontal direction to an upwardly inclined position of said links, the spacing of said links progressively decreasing as said links are moved upwardly from the generally horizontal position of said links, said guides and said guide members being constructed and arranged so that said foot support member remains in a generally horizontal position throughout the pivoting movement of said links.

12. The exercise device as set forth in claim 11 wherein:

said guide members on said foot support assembly remain in a fixed angular relation to each other relative to a horizontal plane throughout the pivoting movement of said links for maintaining said foot support member in a generally horizontal plane.

13. The exercise device as set forth in claim 12 wherein:

said guide members on said foot support member are spaced from each other a predetermined distance which remains constant throughout the pivotal movement of said pair of links.

14. The exercise device as set forth in claim 12 wherein said guides on said links include tracks, and said guide members on said foot support assembly comprise rollers mounted in said tracks for relative translatory movement.

15. The exercise device as set forth in claim 12 wherein:

said resistance means comprises a fluid cylinder mounted between said parallelogram linkage and said support means.

16. An exercise device comprising:

support means including a fixed support member;

a pair of parallelogram linkages each having a pair of spaced generally parallel links mounted for pivoting about horizontal axes on said fixed support member and extending outwardly from said fixed support member, said parallel links defining a pair of spaced guides remaining in a parallel relation to each other during pivoting movement of said links;

a pair of foot support assemblies each having a foot support member extending in a generally horizontal direction and a pair of lower spaced guide members in supporting engagement with said pair of spaced guides, said guides and guide members being mounted for relative translatory movement upon pivoting movement of an associated parallelogram linkage; and resistance means operatively connected to said each linkage of said pair of linkages for resisting downward movement of said foot support member and for returning said each linkage to an upper position when no downward force is applied to said first support member;

said links mounted for pivoting movement in an upper direction about said horizontal axes with spacing of said links progressively decreasing as said links move upwardly, said foot support members remaining in a generally horizontal position throughout the pivoting movement of said links.

17. An exercise device as set forth in claim 16 wherein:

said parallelogram linkages may be pivoted such that said links extend in a horizontal direction for simulation of a cross country skiing exercise.

18. An exercise device as set forth in claim 16 wherein:

said parallelogram linkages may be pivoted such that said links extend in an upwardly inclined direction for simulation of a stair stepping exercise.

19. An exercise device as set forth in claim 16 wherein:

said parallelogram linkages may be pivoted to a position between horizontal and upwardly inclined positions of said links for simulation of a combined stair stepping and cross country skiing exercise.

20. An exercise device as set forth in claim 15 wherein:

said guides on said links comprise tracks, and said guide members on said foot support assembly comprise rollers mounted in said tracks for relative translatory movement.

21. An exercise device comprising:

a base support;

a pair of foot supports for supporting the feet of a user; and guide means connected between said foot supports and said base support for permitting said foot supports to move in a generally vertical direction for simulating a stair stepping exercise or a generally horizontal direction simulating a horizontal skiing exercise;

said guide means designed and arranged to cause said foot supports to remain in a generally horizontal orientation during stair stepping, or skiing exercises.

22. The exercise device of claim 21 further comprising:

force resisting means for resisting movement of said foot supports.

23. The exercise device of claim 22 wherein:

said force resisting means includes spring means for each of said foot supports for returning such foot supports to a said position when weight of a user is lifted therefrom.

24. The exercise device of claim 21 further comprising:

means for interconnecting foot supports of said pair of foot supports for causing upward movement of one foot support when the other foot support is depressed.

25. The exercise device of claim 21 further comprising:

means for interconnecting foot supports of said pair of foot supports for causing forward movement of one foot support when the other foot support is moved to the rear.

26. The exercise device of claim 24 further comprising:

means for interconnecting foot supports of said pair of foot supports for causing forward movement of one foot support when the other foot support is moved to the rear.

* * * * *